US011156397B2

(12) United States Patent
Chen et al.

(10) Patent No.: US 11,156,397 B2
(45) Date of Patent: Oct. 26, 2021

(54) REFRIGERATOR

(71) Applicant: BSH HAUSGERAETE GMBH, Munich (DE)

(72) Inventors: Jinghui Chen, Nanjing (CN); Michael Krapp, Nattheim (DE); Wuba Lei, Chuzhou (CN); Hao Zhang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 332 days.

(21) Appl. No.: 16/192,033

(22) Filed: Nov. 15, 2018

(65) Prior Publication Data

US 2019/0162463 A1 May 30, 2019

(30) Foreign Application Priority Data

Nov. 27, 2017 (CN) ..... 201721604941.1

(51) Int. Cl.
*F25D 23/02* (2006.01)
*F25D 23/00* (2006.01)

(52) U.S. Cl.
CPC ..... *F25D 23/02* (2013.01); *F25D 23/00* (2013.01); *F25D 23/003* (2013.01); *F25D 23/006* (2013.01)

(58) Field of Classification Search
CPC ..... F25D 23/00; F25D 23/02; F25D 23/028; F25D 23/003; F25D 23/067; F25D 23/068; F25D 23/006
See application file for complete search history.

(56) References Cited

U.S. PATENT DOCUMENTS

| | | | | |
|---|---|---|---|---|
| 9,115,926 | B2 * | 8/2015 | Rothmund | F25D 23/006 |
| 10,012,241 | B2 * | 7/2018 | Mutlu Bozay | F04D 29/668 |
| 10,174,988 | B2 * | 1/2019 | Heinrich | F25D 19/003 |
| 10,386,112 | B2 * | 8/2019 | Nordieker | F25D 23/028 |
| 10,415,877 | B2 * | 9/2019 | Faehnle | F25D 29/003 |
| 10,619,920 | B2 * | 4/2020 | Schurr | D06F 58/20 |
| 10,634,416 | B2 * | 4/2020 | Fahnle | F25D 21/14 |
| 10,697,691 | B2 * | 6/2020 | Kerner | F25D 11/02 |
| 10,697,692 | B2 * | 6/2020 | Akalan | F25D 23/003 |

(Continued)

FOREIGN PATENT DOCUMENTS

KR 20020097377 A * 12/2002

*Primary Examiner* — Emmanuel E Duke
(74) *Attorney, Agent, or Firm* — Laurence A. Greenberg; Werner H. Stemer; Ralph E. Locher

(57) ABSTRACT

A refrigerator includes a housing body and a refrigeration system with a compressor and a condenser. A machine room is provided on a lower side of the housing body, to accommodate the compressor and the condenser. A cover body closes the machine room. A positioning member is disposed on a wall of the housing body, to position the cover body on the housing body in a preassembly stage. The cover body is positioned at a pre-determined position on the housing body in a preassembly stage by using a positioning member, for example, fixed in a preassembly stage at a position covering the machine room. A screw hole on the cover body and a screw hole on the housing body are aligned with each other. This assists an assembly operation by enabling screws to be screwed into the screw holes easily and accurately, to further rapidly fix the cover body, thereby improving the installation efficiency of the assembly worker.

7 Claims, 5 Drawing Sheets

(56) References Cited

U.S. PATENT DOCUMENTS

| | | | | |
|---|---|---|---|---|
| 2005/0115272 | A1* | 6/2005 | Lim | F25D 23/10 62/507 |
| 2005/0257556 | A1* | 11/2005 | Lee | F16F 15/04 62/297 |
| 2009/0169387 | A1* | 7/2009 | Yoo | F04D 29/668 416/190 |
| 2010/0242525 | A1* | 9/2010 | Park | F25D 23/003 62/440 |
| 2012/0111049 | A1* | 5/2012 | Kim | F25D 23/126 62/344 |

* cited by examiner

REFRIGERATOR

CROSS-REFERENCE TO RELATED APPLICATION

This application claims the priority, under 35 U.S.C. § 119, of Chinese patent application CN 201721604941.1, filed Nov. 27, 2017; the prior application is herewith incorporated by reference in its entirety.

BACKGROUND OF THE INVENTION

Field of the Invention

The present invention relates to the field of refrigeration technologies, and in particular, to a commercial or household refrigerator.

Refrigerators with a refrigeration system including a compressor, an evaporator, and a condenser are well known in the art. Air that is cooled by the evaporator enters a corresponding storage chamber to reduce the temperature in the corresponding storage chamber. A typical refrigerator is generally provided with different storage chambers. A refrigerating, or cooling, chamber and a freezing chamber are the most typical storage chambers.

A housing body of a refrigerator is provided with a machine room independent of the storage chambers. The machine room is used for accommodating a compressor, a condenser or a fan, and the like. To dissipate heat, the machine room is generally provided with an air inlet and an air outlet on a cover body for opening and closing the machine room. Blowing by the fan promotes air convection between the machine room and the outside to exchange heat.

SUMMARY OF THE INVENTION

It is accordingly an object of the invention to provide a refrigerator which overcomes a variety of disadvantages of the heretofore-known devices and methods of this general type and which provides for a refrigerator in which a cover body of a machine room can be installed more easily.

With the foregoing and other objects in view there is provided, in accordance with the invention, a refrigerator, comprising:

a housing body;

a refrigeration system having a compressor and a condenser;

a machine room provided on a lower side of the housing body, for accommodating the compressor and the condenser;

a cover body for closing the machine room; and a positioning member disposed on a wall of said housing body and configured to position said cover body on said housing body in a preassembly stage of the refrigerator.

In other words, the objects of the invention are achieved by a refrigerator that includes a housing body, also referred to as a box body or, simply, a housing; a refrigeration system, where the refrigeration system includes a compressor and a condenser; a machine room provided on a lower side of the housing body, to accommodate the compressor and the condenser; and a cover body used for closing the machine room. The refrigerator according to the invention further includes a positioning member disposed on a wall of the housing body, to position the cover body on the housing body in a preassembly stage.

Therefore, for example, the following technical advantages can be achieved: The cover body is positioned at a pre-determined position on the housing body in a preassembly stage by using a positioning member, for example, fixed at a position covering the machine room in a preassembly stage, to make good preparations for further accurately fixing the cover body at the position of the machine room on the housing body to cover the machine room. The cover body generally fixedly closes the machine room by screws, and when the cover body is positioned on the housing body in a preassembly stage and closes the machine room, a screw hole on the cover body and a screw hole on the housing body are aligned with each other. This can help a worker screw the screws into the screw holes easily and accurately, to further rapidly fix the cover body, thereby improving the installation efficiency of the worker.

Preferably, the positioning member is disposed on a wall of the machine room.

Preferably, a supporting piece is disposed on the wall of the machine room, and the positioning member is disposed on the supporting piece.

Preferably, the positioning member is installed on the supporting piece by a plug-in connection.

Preferably, the cover body is connected to the positioning member by a plug-in connection or a snap-fit connection.

Preferably, the positioning member includes a snap-fit portion, the cover body has a snap-fit hole engaging with the snap-fit portion, and the snap-fit portion is snapped into the snap-fit hole to connect the cover body to the positioning member.

Preferably, when the cover body is positioned on the housing body in a preassembly stage, the positioning member penetrates the cover body and extends by a pre-determined distance along a direction away from the cover body.

When the refrigerator is placed near a wall body, the back of the refrigerator needs to keep a distance from the wall body, to ensure smooth heat dissipation of the refrigerator. Especially for the machine room on the back of the refrigerator, which is a heat production area, keeping a distance from the wall body is more needed. The positioning member extends by a pre-determined distance along a direction away from the cover body, so that it can be ensured that the back of the refrigerator keeps a pre-determined distance from the wall body.

Preferably, after the cover body is positioned on the housing body in a preassembly stage, the cover body is fixed on the housing body by using a fixing member.

The fixing member is preferably a screw. The fixing manner by using a screw is easy and convenient to operate.

Other features which are considered as characteristic for the invention are set forth in the appended claims.

The main inventive concept of the present invention is to provide a refrigerator, where the refrigerator includes: a housing body; a refrigeration system, where the refrigeration system includes a compressor and a condenser; a machine room provided on a lower side of the housing body, to accommodate the compressor and the condenser; and a cover body used for closing the machine room; and further includes a positioning member disposed on a wall of the housing body, to position the cover body on the housing body in a preassembly stage.

The following describes technical solutions of embodiments of the present invention clearly and completely with reference to the accompanying drawings in the embodiments of the present invention. Obviously, the described embodiments are merely some embodiments of the present invention, but are not all embodiments. Based on the embodiments of the present invention, all other embodiments obtained by a person of ordinary skill in the art without creative efforts shall fall within the protection scope of the present invention.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
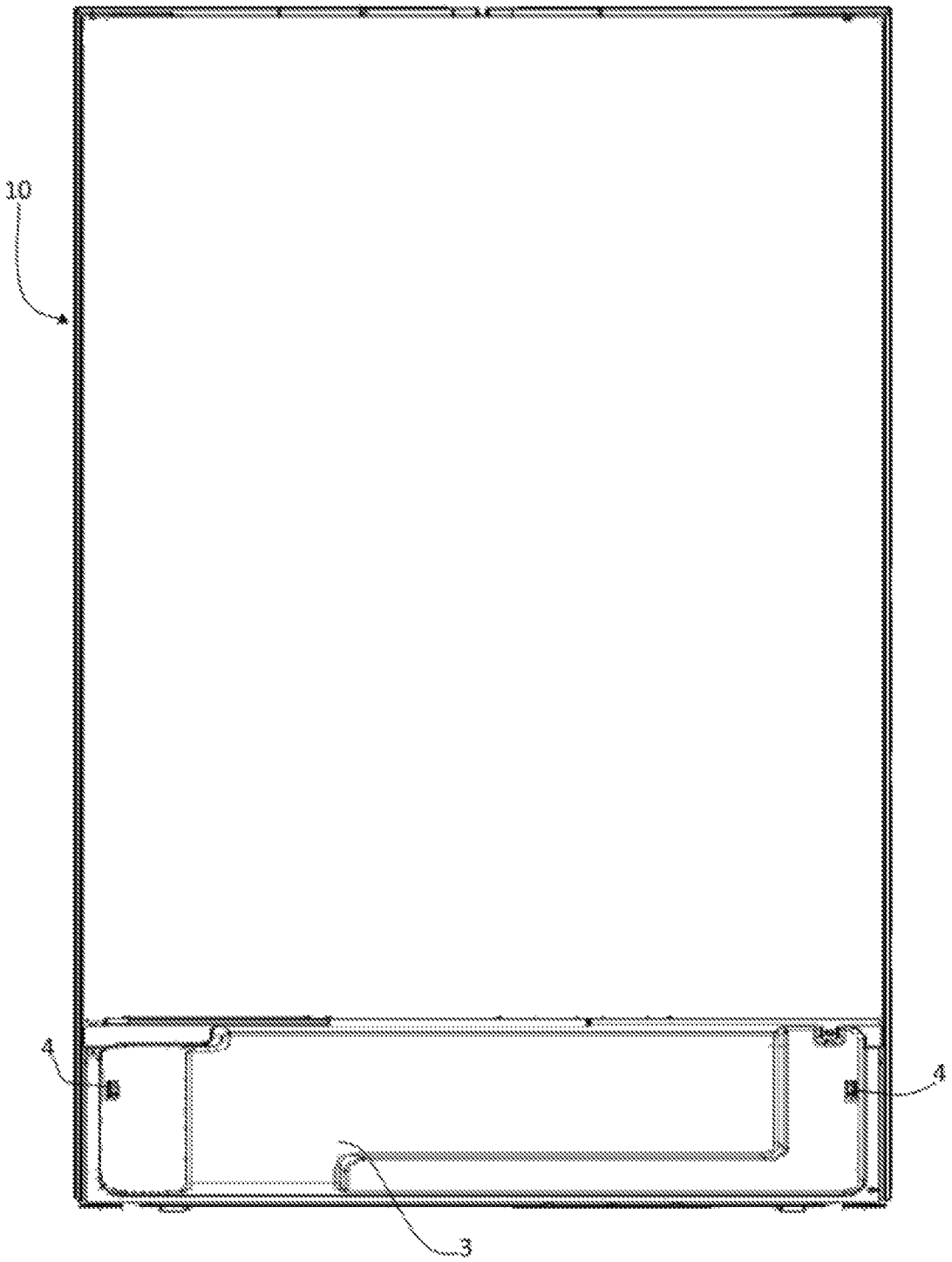
FIG. 1 is a schematic elevation view of a housing body of a refrigerator roughly viewed from the back of the refrigerator.
Figure 2:
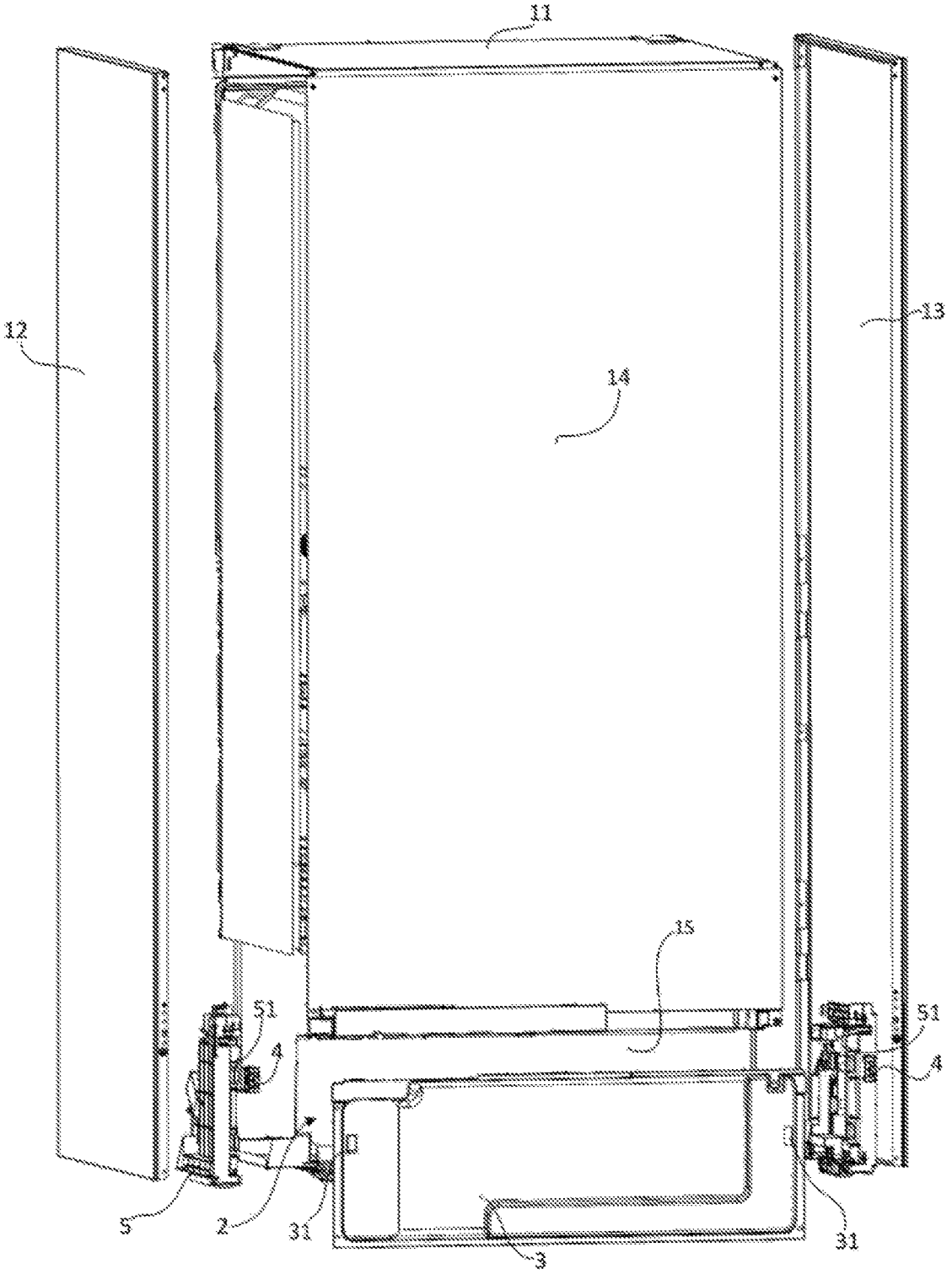
FIG. 2 is a perspective and schematic exploded view of FIG. 1.

Referring now to the figures of the drawing in detail and first, particularly, to FIG. 1 thereof, there is shown a schematic three-dimensional view of a housing body of a refrigerator roughly viewed from the back of the refrigerator. FIG. 2 is a schematic exploded view of FIG. 1. As shown in FIG. 1 and FIG. 2, the housing body 10 of the refrigerator generally includes a shell, an inner liner defining storage chambers, and a heat insulation layer (not shown in the figures) between the shell and the inner liner, and a front opening of the housing body 10 is generally closed by a door body that may be opened and closed. The shell includes a top wall 11, a left side wall 12, a right side wall 13, a back wall 14, and a bottom wall 15. A machine room 2 is molded on a lower side of the housing body 10, and the machine room 2 is roughly formed by the left side wall 12, the right side wall 13, and the bottom wall 15 that is roughly Z-shaped. A cover body 3 that may open and close the machine room 2 closes the machine room 2. The cover body 3 and the back wall 14 of the housing body 10 are basically seamlessly connected to form an integral plane. The cover body 3 may also be basically regarded as a part of the back of the entire housing body.

A refrigeration system of the refrigerator generally includes a compressor, a condenser, a capillary tube, an evaporator corresponding to the storage chambers, and cooling pipes for connecting the foregoing cooling components, to form a circulating refrigeration system for cooling the storage chambers.

In this embodiment, both the compressor and the condenser are accommodated in the machine room 2 located on the lower side of the housing body 10. To enhance air convection between the inner side of the machine room 2 and the outside, to better discharge heat in the machine room 2, a fan is generally disposed in the machine room 2 to drive air to flow, to better cool the machine room 2. Preferably, the fan is disposed between the condenser and the compressor, and drives air to forcibly flow from the condenser to the compressor.

The compressor, the fan, and the condenser are separately fixed on a bottom plate (not shown in the figure) side by side by using multiple fixing devices. The bottom plate and the bottom wall 15 of the housing body 10 are basically seamlessly connected to form an integral plane, thereby roughly constituting the bottom of the housing body 10.

In a production and manufacture process, to fix the cover body 3 on the housing body 10 to close the machine room 2, a worker generally uses one hand to pre-fix the cover body 10 on the position of the machine room 2, and then uses the other hand to screw screws for fixation. This operation is quite inconvenient. To resolve the problem, in this embodiment of the present invention, a positioning member is disposed on a wall of the housing body, to position the cover body on the housing body in a preassembly stage, especially fixed at the position of the machine room in a preassembly stage, to make good preparations for further fixing by using large screws.

As shown in FIG. 2, the positioning member 4 is disposed on a wall of the machine room 2, especially disposed on a left wall 12 and a right wall 13 of the housing body that constitute a left wall and a right wall of the machine room 2. A supporting piece 5 is separately disposed on the left wall and the right wall of the machine room 1, and the positioning member 4 is preferably disposed on the supporting piece 5, so that the positioning member can be fixedly installed more easily.

Figure 3:
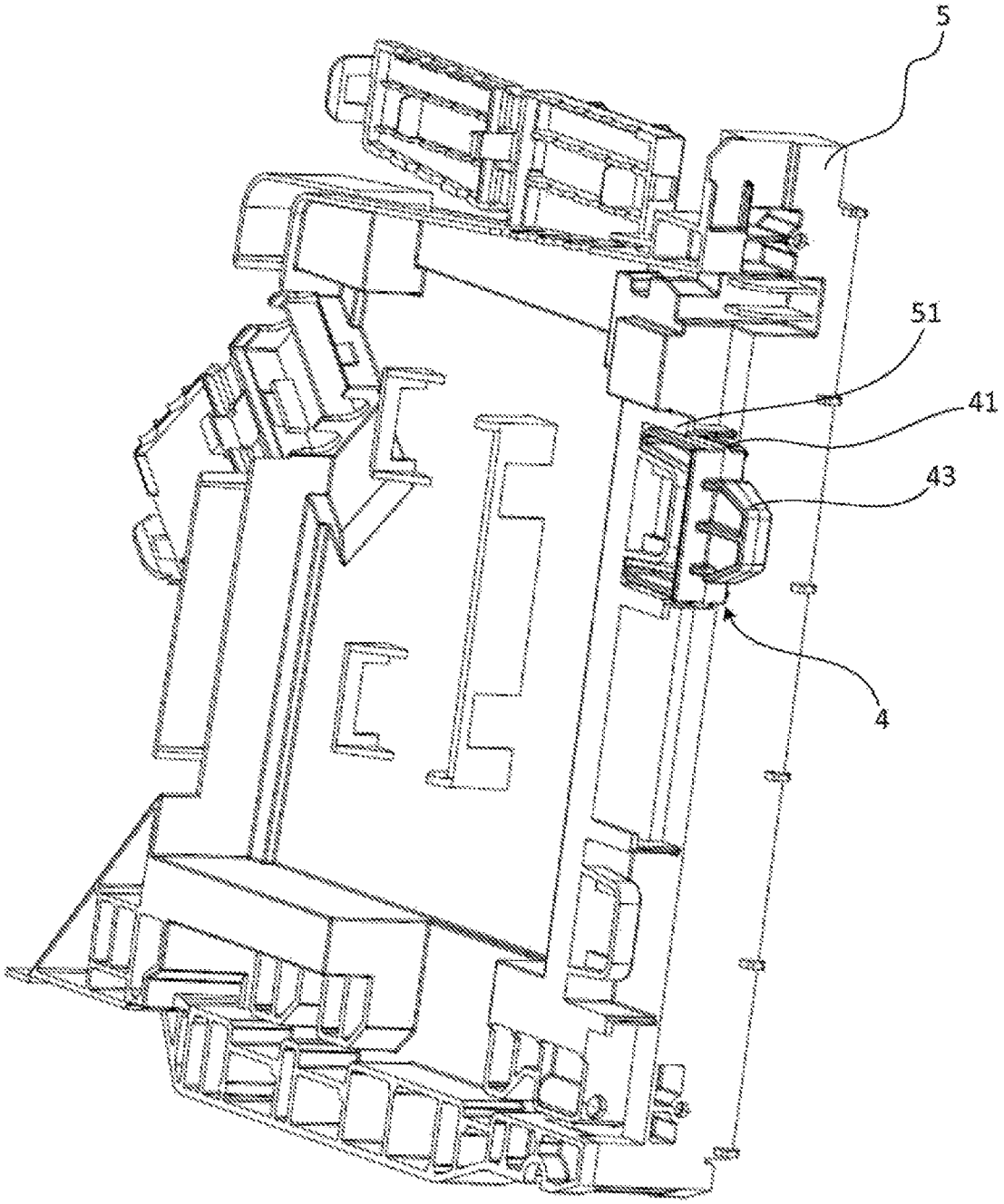
FIG. 3 is a perspective structural view of a supporting piece.
Figure 4:
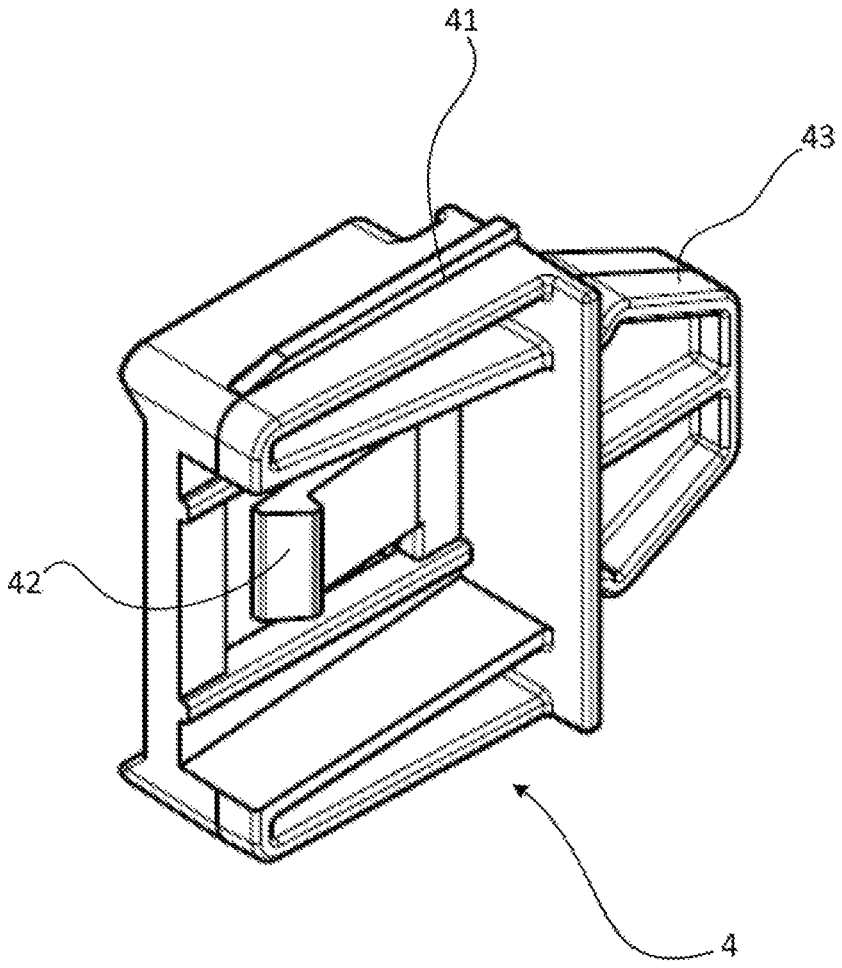
FIG. 4 is a perspective view of a positioning member.

FIG. 3 is a schematic structural view of a supporting piece. FIG. 4 is a schematic structural view of a positioning member. As shown in FIG. 2, FIG. 3, and FIG. 4, a slot 51 is disposed on the supporting piece 5, and the positioning member 4 has an inserting portion 41, to be inserted into the slot 51, to connect the positioning member 4 to the supporting piece 5 by a plug-in connection. A hook 42 is further disposed on the inserting portion 41 of the positioning member 4, and when the inserting portion 41 is inserted into the slot 51, the hook 42 exactly hooks a rib disposed in the slot 51, to implement locking connection. The positioning member 4 further has a snap-fit portion 43, to engage with a snap-fit hole 31 provided on the cover body 3, and the snap-fit portion 43 is snapped into the snap-fit hole 31, to connect the cover body 3 to the positioning member 4. After the snap-fit portion 43 is snapped into the snap-fit hole 31, the snap-fit portion 43 locks the edge of the snap-fit hole 31, to implement a locking effect to prevent the cover body 3 from falling from the positioning member 4, so that the cover body 3 can be stably positioned on the housing body 10 in a preassembly stage. When the cover body 3 is positioned on the housing body 10 in a preassembly stage and closes the machine room 2, a screw hole on the cover body 3 and a screw hole on the housing body 10 are aligned with each other. This can help a worker screw screws into the screw holes easily and accurately, to further rapidly fix the cover body 3, thereby improving the installation efficiency of the worker.

Figure 5:
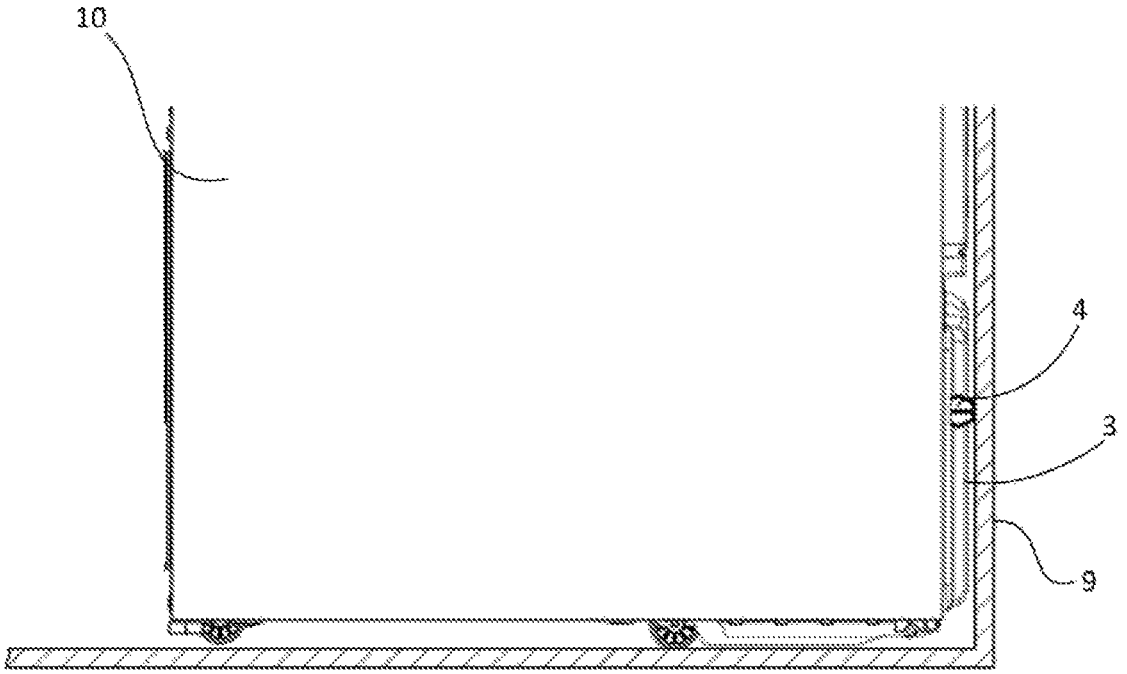
FIG. 5 is a partial schematic elevation view of a housing body placed near a wall body.

FIG. 5 is a partial schematic view of a housing body placed near a wall body. As shown in FIG. 5, when the cover body 3 is fixed on the housing body 10 and closes the machine room 2, the positioning member 4 penetrates the cover body 3 and extends by a pre-determined distance along a direction away from the cover body 3. Therefore, the back of the housing body 10 cannot be placed against the wall body 9, and a heat dissipation space is reserved for the housing body 10 and the machine room 2 artificially, so that when a user places the refrigerator, the refrigerator is prevented from being placed excessively near the wall body to cause poor heat dissipation of the refrigerator and affect the refrigeration efficiency of the refrigerator.

The foregoing description for the disclosed embodiments enables a person skilled in the art to implement or use the present invention. Various modifications made to these embodiments are obvious to the person skilled in the art, and the general principles defined in this specification may be implemented in other embodiments without departing from the spirit and scope of the present invention. Therefore, the present invention is not limited to these embodiments shown in this specification, but needs to conform to the widest scope that is consistent with the principles and the novel features disclosed in this specification.

The invention claimed is:

1. A refrigerator, comprising: a housing body; a refrigeration system having a compressor and a condenser; a machine room provided on a lower side of the housing body, for accommodating said compressor and said condenser; a cover body for closing said machine room; and a positioning member disposed on a wall of said housing body and configured to position said cover body on said housing body in a preassembly stage of the refrigerator; and a supporting piece is disposed on said wall of said machine room, said positioning member is disposed on said supporting piece.

2. The refrigerator according to claim 1, wherein said positioning member is fixed on said supporting piece by a plug-in connection.

3. The refrigerator according to claim 1, wherein said cover body is connected to said positioning member by way of a plug-in connection or a snap-fit connection.

4. The refrigerator according to claim 3, wherein said positioning member comprises a snap-fit portion, said cover body is formed with a snap-fit hole engaging with said snap-fit portion, and said snap-fit portion is snapped into said snap-fit hole to connect said cover body to said positioning member.

5. The refrigerator according to claim 1, wherein when said cover body is positioned on said housing body in a preassembly stage, said positioning member penetrates said cover body and extends by a pre-determined distance along a direction away from said cover body.

6. The refrigerator according to claim 1, wherein after said cover body is positioned on said housing body in a preassembly stage, said cover body is fixed on said housing body by way of a fixing member.

7. The refrigerator according to claim 1, wherein said cover body has a first screw hole and said housing body has a second screw hole, said positioning member being configured for aligning said first screw hole and said second screw hole during the preassembly stage.

* * * * *